United States Patent [19]

Green

[11] 3,942,725

[45] Mar. 9, 1976

[54] SPRAYHEAD FOR SWIRLING SPRAY

[76] Inventor: Edward H. Green, 57 Interstate Road, Addison, Ill. 60101

[22] Filed: Jan. 3, 1975

[21] Appl. No.: 538,440

[52] U.S. Cl. ..... 239/468; 239/579; 239/490

[51] Int. Cl.[2] ..... B05B 1/34

[58] Field of Search ..... 239/573, 579, 468, 491, 239/492, 337, 490

[56] References Cited

UNITED STATES PATENTS

| | | | |
|---|---|---|---|
| 3,083,917 | 4/1963 | Abplanalp et al. | 239/468 |
| 3,471,092 | 10/1969 | Hickey | 239/579 |
| 3,519,210 | 7/1970 | Du Plain | 239/579 X |

*Primary Examiner*—M. Henson Wood, Jr.
*Assistant Examiner*—Michael Mar
*Attorney, Agent, or Firm*—Perry Carvellas

[57] ABSTRACT

The present invention is directed to an aerosol spray apparatus comprising two parts which when joined or brought into a sealing engagement cooperate to form a mechanical break up means. The mechanical break up consists of a sprayhead and stem which cooperate to form a swirl forming means which mechanically breaks up pressurized materials being dispensed. The swirl forming means comprises a swirl chamber which is arranged concentrically to a spray orifice, two tangential channels which are directed tangentially into the swirl chamber and two annular channels. The swirl forming chamber and tangential channels are formed by depressions molded into the inner wall surface of the socket of the sprayhead. The two annular channels are formed by depressions molded into the surface of the valve stem. The swirl chamber and tangential channels are covered by a tightly fitted outer wall surface portion of the stem. The tangential channels with the stem form passageways for the pressurized materials. The two annular channels in the surface of the stem are covered by a tightly fitted inner wall surface of the socket of the sprayhead. The annular channels with the sprayhead form passageways for the pressurized material. Regardless of the manner in which the stem and sprayhead are brought together the swirl forming chamber will always be properly aligned relative to the stem.

17 Claims, 11 Drawing Figures

SPRAYHEAD FOR SWIRLING SPRAY

SUMMARY OF THE INVENTION

The present invention relates to aerosol valves and to new and improved sprayheads for use therewith. The invention relates to mechanical break up and swirl forming means for use with aerosol dispensers. The invention is particulary directed to a novel sprayhead and a valve stem structure which cooperate to form a mechanical break up and swirl forming means. The mechanical break up means consist of the sprayhead and the valve stem.

The swirl forming means comprises a swirl chamber which is arranged concentrically to a spray orifice, and two tangential channels which are directed tangentially into the swirl chamber. There is an upper tangential channel and a lower tangential channel. The swirl forming chamber and tangential channels are formed by depressions molded into the inner wall surface of the socket of the sprayhead. There are communicating means connecting the hollow bore of the valve stem with the tangential channels. The communicating means can comprise two annular channels formed by depressions molded into the surface of the valve stem. There is an upper annular channel and a lower annular channel. The swirl chamber and tangential channels are covered by the tightly fitted outer wall surface portion of the stem. The tangential channels with the stem form passageways for the pressurized materials. The two annular channels in the surface of the stem are covered by the tightly fitted inner wall surface of the socket of the sprayhead. The annular channels with the socket form passageways for the pressurized material.

The sprayhead socket and stem are dimensioned to provide a tight fit between the stem and the socket. In this manner pressurized product cannot escape from the pressurized container except by way of the passageways formed by the tangential channels and the passageways formed by the annular channels.

The upper tangential channel communicates at one end with the swirl forming chamber and at the other end with the upper annular channel. The lower tangential channel communicates at one end with the swirl forming chamber and at the other end with the lower annular channel.

Each of the tangential channels feed pressurized materials from the annular channel with which it is in communication to the swirl forming chamber. The flow of pressurized material into the swirl forming chamber produces a swirl action of the material which action continues as the material emerges from the spray orifice and a fine atomization of dispersion of the material is obtained.

A notch in the top portion of the stem forms communicating means between the bore of the hollow stem and the upper annular channel. An orifice in the stem below the notch forms communicating passage means between the bore of the stem and the lower annular channel.

In another embodiment of the invention, the upper and lower annular channels are formed on the inner wall surface of the sprayhead socket.

In still another embodiment of the invention, the upper annular channel and notch are omitted and communication between the bore of the hollow stem and the upper tangential channel is provided by spacing the upper surface of the top of the valve stem a short distance below the top wall surface of the socket of the sprayhead.

The sprayhead and valve stem are constructed in such a manner that it is not necessary to align the sprayhead and stem relative to each other prior to assembly. The ability to assemble the sprayhead and stem without having to align them comprises an important feature of the invention.

Prior to the present invention the swirling spray had been produced by specially constructed sprayheads, which were characterized by complicated structure and construction means. Generally the sprayheads were made of a plurality of parts which had to be separately assembled to obtain the necessary duct and chamber formations, and had to be aligned relative to each other prior to assembly. This type of swirl forming means was expensive to produce and materially added to the cost of the dispensing mechanism as a whole.

It is an object of the present invention to provide a sprayhead constructed of a minimum of simple and economically produced parts which are easily assembled.

An object of the invention is to provide a sprayhead which may be used with different valve stem and valve structures.

An object of the present invention is to provide a swirl forming mechanical break up means in which the complete sprayhead structure may be made in a single pressure molding.

An object of the present invention is to provide a sprayhead of mechanical simplicity which affords excellent atomization and dispersion of a liquid.

An object of the invention is to provide a mechanical break up means consisting of only two parts which can be manufactured inexpensively and assembled by existing automatic equipment.

The sprayhead of the present invention is briefly discussed with reference to the Figures of the drawings. The sprayhead has a frusto-conical shaped socket formed therein which conforms essentially in size and shape to the upper portion of the hollow stem which is also frusto-conical in shape. The sprayhead socket and valve stem are dimensioned such that when they are engaged there is a tight fit between them and a tight seal obtained. The swirl forming means are defined by the swirl forming chamber and the tangential channels formed between the frusto-conical shaped inner wall surface 29 of the sprayhead socket 28 and the frusto-conical shaped outer wall surface 24 of the hollow valve stem 18. A generally round swirl forming chamber 47 is formed in the inner wall surface of the socket and communicates with spray orifice 36. There is an upper tangential channel 42 and a lower tangential channel 42 formed in the inner wall surface of the socket. The swirl forming chamber communicates with tangential channels 42 along an edge of the swirl chamber 47 at two locations spaced equidistant from each other. An upper annular channel 51 and a lower annular channel 39 are formed on the outer wall surface of the stem. The outer ends of the upper and lower tangential channels 42 intersect annular channels 51 and 39 respectively. The outer wall surface 24 of the valve stem 18 together with the channels 42 form enclosed passageways through which pressurized material can flow. The inner wall surface 29 of the socket 28 together with channels 39 and 51 form enclosed passageways through which pressurized material can flow.

A notch 37 or communicating passage means may be molded or otherwise formed in the top of the stem 18 such that when the stem top wall surface 48 is brought into or substantially into engagement with the top wall surface 41 of socket 28 a passage 37 is formed which communicates with annular channel 51 and the bore 23 of the valve stem 18. An orifice or second communicating passage means 38 spaced below the notch may be molded or otherwise formed in the wall of stem 18 to form a passage which communicates with annular channel 39 and the bore 23 of the valve stem 18.

When the sprayhead 1 is depressed to open the aerosol dispensing valve, the pressurized material in the container will flow upwardly through the bore 23, through the horizontal passage 37 and orifice 38 into, and outward and around in the annular channels 39 and 51, respectively and through each of the two tangential passageways 42, into the swirl forming chamber 47 and out through spray orifice 36.

At the place in the swirl forming chamber 47 where tangential passageways 42 intersect, a swirling action is imparted to the pressurized product being dispensed which atomizes the material as it passes through the orifice 36 and disperses the product as a fine spray.

Because the swirl chamber is of relatively small volume as compared to the volume of pressurized mixture entering through the tangential channels, the pressurized mixture is caused to swirl at a high velocity before being discharged to the atmosphere through the spray orifice.

Clogging of the passages of the sprayhead is frequently a serious problem in the case of certain heavy materials which are dispensed at high rates. Because the sprayhead of the present invention has two tangential channels, i.e. an upper and a lower channel, any spray material remaining after spraying in the tangential channels can drain downward into the lower annular channel and into the hollow stem bore. The sprayhead of the present invention is thus practically non-clogging.

In accordance with an embodiment of the present invention the dies used to mold the sprayhead and valve stem are made of unique construction which allow the single "shot" molding of the desired sprayhead and valve stem structures. The dies are such that they can be used in conventional pressure molding machines, utilizing a suitable type of plastic molding material.

The preferred embodiment of the invention comprises molding the sprayhead socket to have a frusto-conical shape portion and a cylindrical shaped portion. The included angle at the apex of the frusto-conical shaped portion, considering a vertical plane taken through the center of the sprayhead, can be 10° to 170° and preferably 60° to 90°. In a particular embodiment, the angle can be 20°–30°.

The upper portion of the valve stem is molded to have a frusto-conical shaped portion and a cylindrical shaped portion.

The included angle at the apex of the frusto-conical shaped portion, considering a vertical plane taken through the center of the valve stem, can be 10° to 170° and preferably 60° to 90°. In a particular embodiment the angle can be 20°–30°.

The shape of the valve stem conforms to the shape of the inner socket of the sprayhead. The sprayhead socket and valve stem are dimensioned such that when the stem is engaged in the sprayhead socket a tight sealing fit is obtained.

By having the sprayhead socket molded in the form of a frusto-conical shape and having the wall of the swirl chamber and the wall of the tangential channel slanting inwardly in the inner wall surface of the sprayhead socket, the die used to mold the sprayhead can be constructed in such a manner that it is easily removably from the molded plastic part without risking damage to the walls of the swirl chamber and tangential channels. This is particularly true of the lower wall of the swirl forming chamber and the lower wall of the lower tangential channel.

In accordance with the present invention the die used to mold the inner wall surface of the sprayhead can, after the molding step, be pulled vertically downward and out of the molded sprayhead leaving the swirl chamber and tangential channels in the precise condition as intended.

In the design of the sprayhead as herein contemplated there are no or substantially no under cut portions of the molded part that can be damaged by withdrawal of the die.

Further, the present invention allows use of harder faster setting plastic materials which perform better and last longer, since it is not necessary for the molded plastic material to remain soft long enough to remove the die so as to allow withdrawal of the die from undercut portions of the molded plastic part. Normally the removal of the die from an undercut portion of the molded plastic part disrupts the undercut portion, which after removal of the die is hoped returns to its previous position without damage.

BRIEF DESCRIPTION OF THE DRAWINGS

In a detailed description of the drawings that follows the same characters of reference are used whenever feasible to designate the same or similar parts throughout the several figures thereof.

DESCRIPTION OF THE PREFERRED EMBODIMENTS

Figure 1:
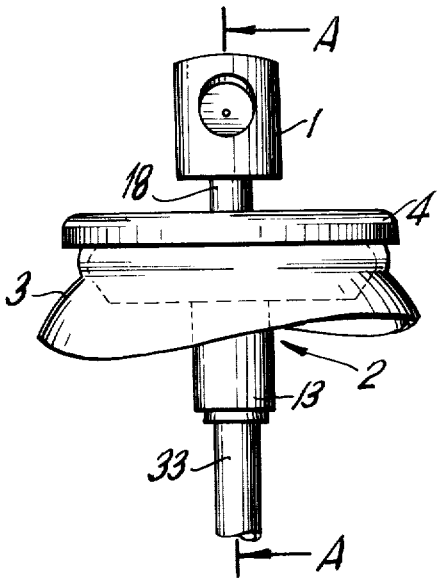
FIG. 1 is a fragmentary front elevational view of a valve assembly mounted on a pressurized container and a sprayhead constructed in accordance with the invention.
Figure 2:
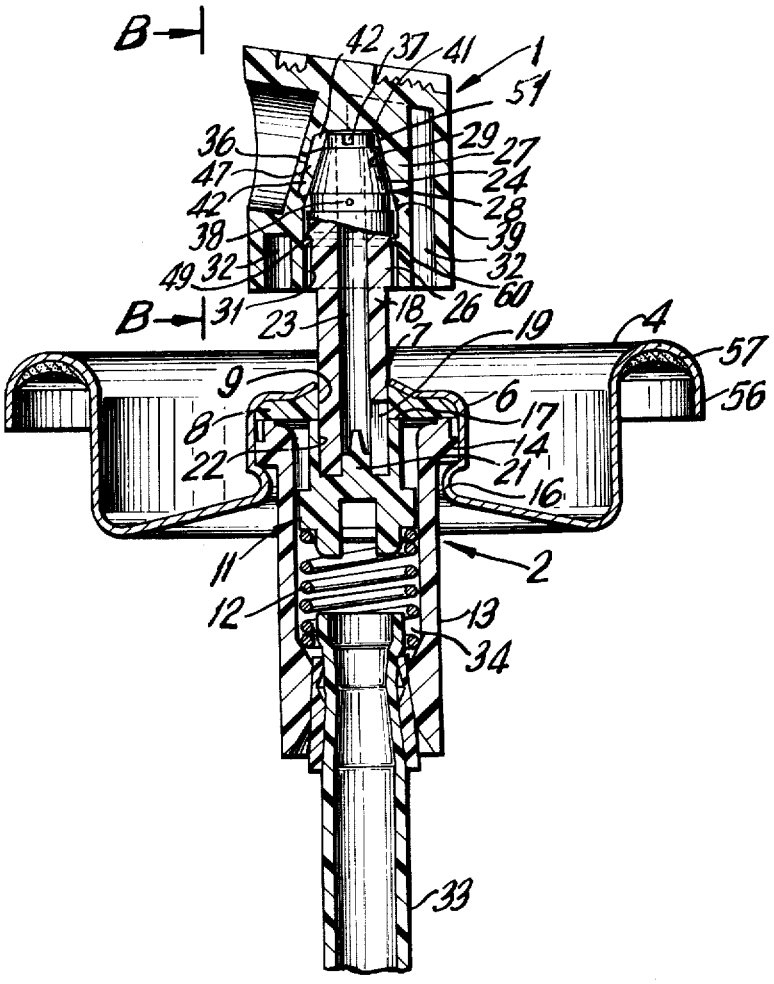
FIG. 2 is an enlarged fragmentary sectional view taken along line A—A of FIG. 1, in the direction shown, illustrating a valve assembly construction in which the stem and valve plunger are separable and in which the valve stem has in the lower portion thereof a clear through metering slot.

Now referring to FIGS. 1 to 4 there is illustrated a sprayhead 1 constructed in accordance with the invention, here shown mounted upon a valve structure designated generally 2 that is normally carried on a pressurized container 3. The assembly as shown in FIG. 2 with the sprayhead in place is the form in which the structure is normally sold to packers of pressurized products. The sprayhead, however, may or may not be sold with the valve. The containers normally used consist of a canister or bottle having a cover member 4 secured over the top thereof. The cover member 4 is of sheet metal suitably stamped and shaped to provide a central boss or pedestal formation 6 having a coaxial central aperture 7. An annular rubber gasket 8 is clamped in position inside of the pedestal formation 6 with its central opening 9 coaxial with the aperture 7. The valve structure 2 includes a valve plunger 11 that is normally biased upward by means of a coiled spring 12 contained within the valve housing 13. The upper flanged end 14 of the valve housing 13 is crimped as at 16 to the bottom of the gasket 8. The valve plunger 11 is intended to ride up and down inside of the valve housing 13, and has an upper edge forming a valve seat 17 which engages the bottom of the gasket 8 around its central opening 9 in valve sealing relationship.

The sprayhead 1 has a depending hollow stem 18 which slidingly and sealingly engages through the said central opening 9 of the gasket 8 in operating the valve structure. The bottom end of the stem engages into and upwardly opening socket 22 of valve plunger 11 and is provided with an axially extending metering slot 19 that is open through the wall of the stem and extends upward into the gasket 8 a slight distance and is sealed by the gasket when the valve member is seated. The bottom of the stem fits over upstanding pilot member 21 formed in the bottom of valve plunger socket 22.

The hollow stem 18 has a central bore 23. Thus, when the valve stem is pushed downward by the user pressing on the top of the sprayhead 1 the valve seat 17 will be unseated from the bottom of the gasket 8 and access will be had for the propelled mixture coming up from the bottom of the pressurized container 3 by way of the dip tube 33 into the interior chamber 34 of the valve housing 13. The mixture will pass up alongside and around the valve plunger 11, past the valve seat 17 into and through the slot 19 and up into the conduit 23 to be dispensed from spray orifice 36.

The body 27 of the sprayhead 1 has a socket 28 formed therein, with an upper frusto-conical shaped section 29 and a cylindrical section 31 immediately therebelow. Portions of the body of the sprayhead may be hollowed out as at 32 to lighten and minimize the amount of material needed to mold it. The bore 23 of the hollow stem 18 continues up into the sprayhead and opens to communicating passage means which in this embodiment consists of a notch 37 which communicates with the upper annular channel 51 and orifice 38 which communicates with lower annular channel 39.

The cross-sectional areas of the slot 37 and orifice 38 may be greater or less than the cross-sectional area of the spray orifice 36. The sprayhead socket 28 is formed on the inside of the body portion 27 of the sprayhead 1. The portion 31 of the socket is cylindrical in shape and the portion 29 is frusto-conical in shape and has an upper flat circular wall 41. When the stem is engaged with the sprayhead, communication is established between the bore 23 of the stem and the annular channels 51 and 39 regardless of the orientation of the stem and sprayhead when they are put together.

The swirl forming means is molded into the inner wall surface 29 of the socket 28 (see FIGS. 3 and 4) and comprises swirl chamber 47 and tangential channels 42. When the stem is engaged in the socket, the outer wall surface of the stem forms a wall surface of the chamber 47. Opposite this wall surface is spray orifice 36.

The annular channels 51 and 39 and slot 37 and orifice 38 in the stem 18 can be molded at the same time the stem is molded. The slot 37 communicates with annular channel 51. The orifice 38 communicates with annular channel 39. When the sprayhead is depressed the pressurized mixture passes through slot 37 and orifice 38 out and around in annular channels 51 and 39, respectively and enters into each of tangential channels 42 and then into swirl chamber 47 and out of spray orifice 36.

The upper portion 24 of the stem is frusto-conical in shape having a horizontal upper surface 48. The portion 26 of the stem immediately below the frusto-conical shaped portion is cylindrical in shape. The portions 24 and 26 of the stem 18 conform to and are complimentary in shape to the corresponding portions 29 and 31 of the socket of the sprayhead.

The tangential channels 42 are such that there are passageways formed between the inner wall of the frusto-conical shaped portion 29 of the sprayhead 28 and the outer wall surface of the frusto-conical shaped portion 24 of the stem 18 to transport pressurized material. The annular channels 51 and 39 formed on the outer wall surface of the stem are such that there are passageways formed between the inner wall surface of the frusto-conical shaped portion 29 of the sprayhead socket 28 and the outer wall surface of the frusto-conical shaped portion 24 of the stem 18 to transport pressurized material. The frusto-conical shaped portions and the cylindrical shaped portions of the sprayhead and stem are dimensioned to provide a tight sealing fit. For example, the upper surface 48 of the upper portion of the stem 24 can be spaced slightly below the upper wall 41 of the upper portion 29 of the socket 28 to assure a tight fit of the frusto-conical portion of the stem with the frusto-conical portion of the socket.

During molding, the stem 18 may be provided with a small annular bead 49 and the sprayhead socket may be provided with a cooperating small annular bead 60 such that when the stem is inserted into the socket 28 the bead 49 will cooperate with bead 60 on the side wall of the socket 28 and lock therewith forming a very effective seal substantially permanently attaching the stem and sprayhead.

When the stem is seated in the sprayhead socket the upper wall surface 41 of the sprayhead socket forms a top wall surface of slot 37 communicating passage.

The side walls of annular channels 51 and 39 of the stem are generally vertical and the bottom walls are generally horizontal. The top, bottom and side walls of the tangential channels 42 slant generally inwardly in the direction of the wall of the socket. The top, bottom and side walls of swirl forming chamber 47 slant generally inwardly in the direction of into the wall of the socket.

By having the walls of the annular channels, the swirl forming chamber and the tangential channels constructed in the aforesaid manner, substantial advantages in molding and constructing of the sprayhead and swirl forming chamber are achieved. For example, the dies used to mold the sprayhead and stem can be pulled directly away from the molded part without damaging the molded part.

Figure 5:
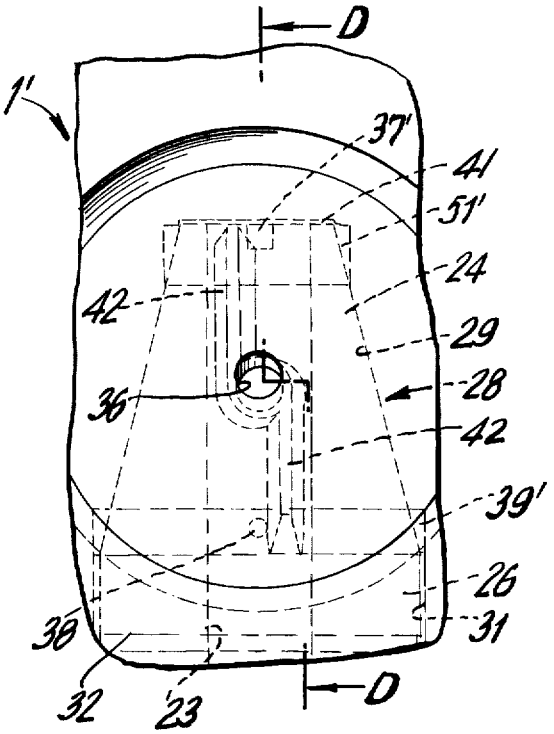
FIG. 5 is a median section through the sprayhead, similar to FIG. 3, showing an enlarged view of the sprayhead and valve stem of an embodiment in which the annular channels are formed in the sprayhead socket.
Figure 6:
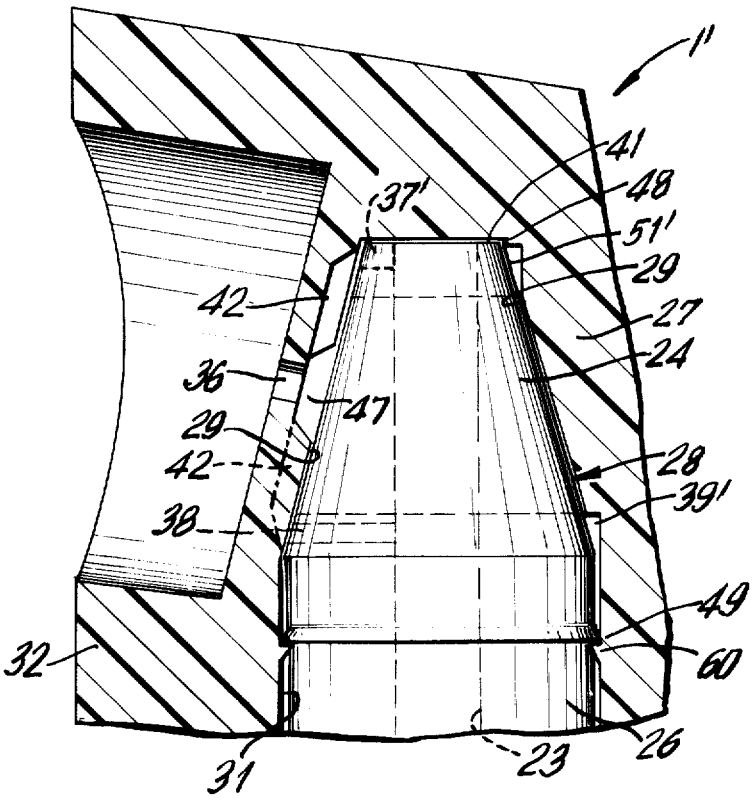
FIG. 6 is an enlarged detailed sectional view of the sprayhead, taken along line D—D of FIG. 5, in the indicated direction.

FIGS. 5 and 6 of the drawings are of an embodiment of the invention in which the annular channels 51' and 39' are formed in the inner wall surface of the sprayhead socket. The inner wall surface 29 of the sprayhead has a central opening that forms the exterior spray orifice 36. The pressurized mixture is sprayed or dispersed from orifice 36. Coaxially with the external metering orifice 36 there is the swirl forming chamber 47. The chamber 47 is shown here as generally round and has two tangential branches or channels 42. Swirl chamber 47 communicates directly with the orifice 36, and through the two tangential channels 42 with annular channels 51' and 39' respectively, formed in the inner wall surface 29 of the sprayhead socket. Swirl chamber 47 and annular channels 39' and 51' are formed in the inner wall surface 29 of the frusto-conical shaped portion of socket 28 during the molding of the sprayhead 1'.

When the stem is pressed into the socket and forms a tight fit therewith there will be formed between the inner wall of the frusto-conical shaped portion of the socket and the frusto-conical portion 24 of the valve stem 18 the swirl chamber 47, two tangential passages 42 and the annular passages 51' and 39'. The annular channels 51' and 39' are covered by the outer wall surface 24 of the valve stem 18. The slot 37 in the upper portion of the stem 18 forms with the upper wall surface 41 of the socket 28 a communicating passage. Pressurized mixture entering through slot 37 and orifice 38 will pass in both directions outward and around in annular channels 51' and 39', respectively and into the tangential channels 42.

The propelled mixture enters the swirl chamber 47 at two points tangential to the chamber causing a rotative or swirl movement of the propelled mixture within the chamber 47 and is discharged through spray orifice 36.

Figure 3:
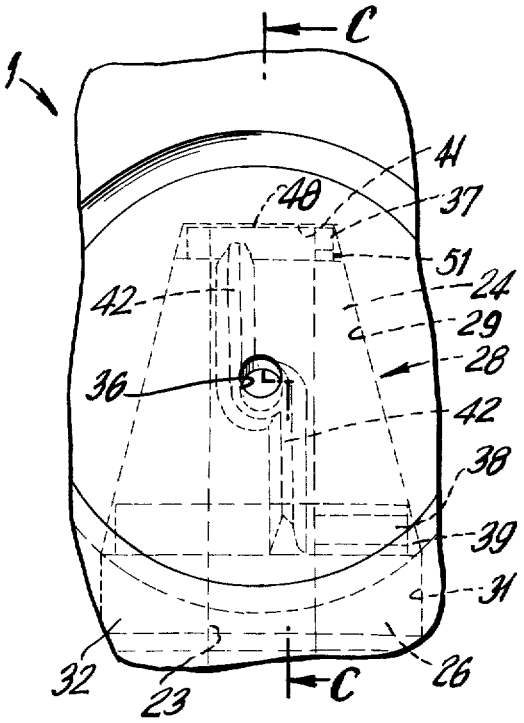
FIG. 3 is a median section through the sprayhead, taken along line B—B of FIG. 2, in the indicated direction, showing an enlarged view of the sprayhead and valve stem in which the annular channels are formed on the valve stem.
Figure 4:
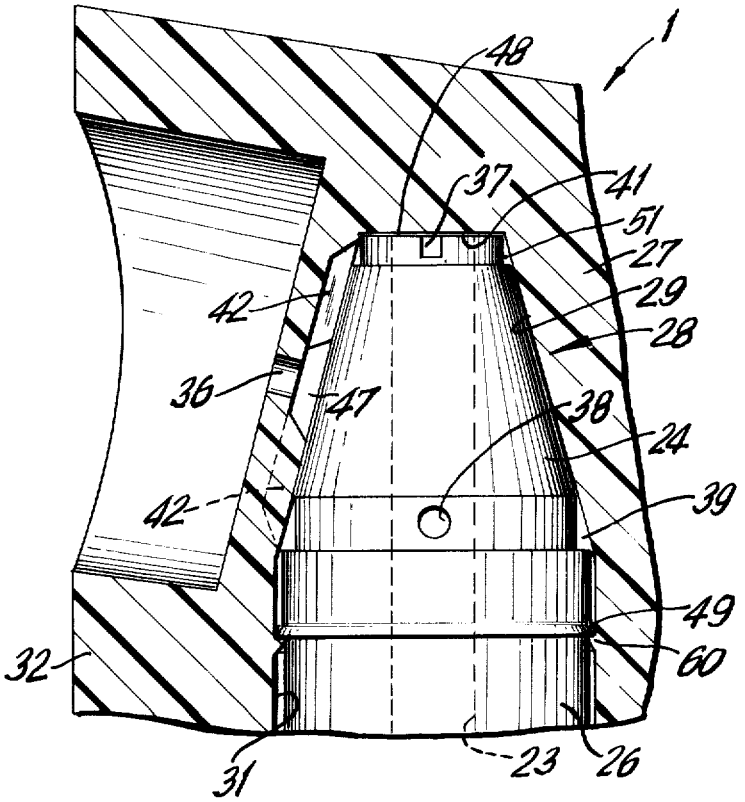
FIG. 4 is an enlarged detailed sectional view of the sprayhead, taken along line C—C of FIG. 3, in the indicated direction.

It will be appreciated from the above discussion that the embodiment shown in FIGS. 5 and 6 is similar in construction and operation to that shown in FIGS. 3 and 4 except that in FIGS. 5 and 6 the annular channels 51' and 39' are molded in the sprayhead socket.

Figure 7:
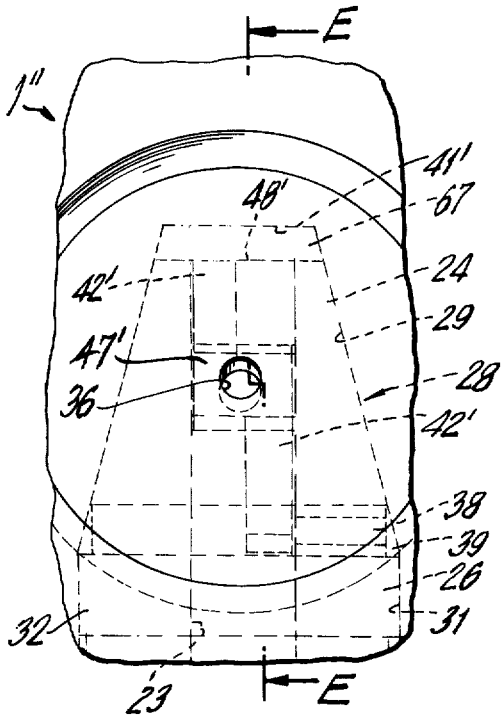
FIG. 7 is a median section through a sprayhead similar to FIG. 3, showing an enlarged view of the sprayhead and valve stem of an embodiment in which the upper annular channel and notch are omitted and the lower annular channel is formed on the valve stem.
Figure 8:
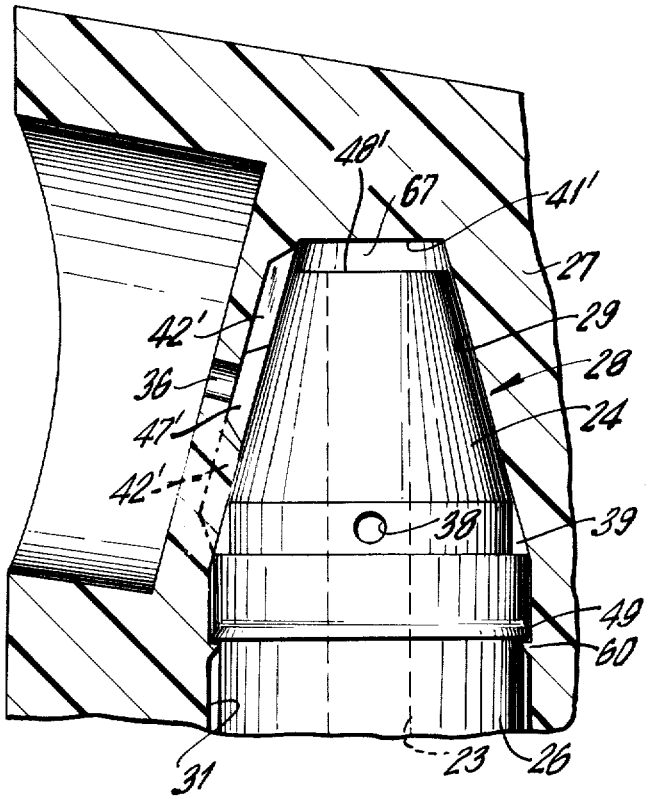
FIG. 8 is an enlarged detailed sectional view of the sprayhead taken along line E—E of FIG. 7, in the indicated direction.

FIGS. 7 and 8 of the drawings are of an embodiment in which the upper annular channel and notch are omitted and communication between the bore 23 of the stem 18 and the upper tangential channel 42' is provided by communicating passage 67. Communication between the bore 23 and the lower tangential channel 42' is provided as before by a lower annular channel 39 and orifice 38. The communicating passage 67 is obtained by spacing the upper surface 48' of the upper portion of the stem 24 below the upper wall 41' of the upper portion 29 of the socket 28. The upper surface 48' is spaced a sufficient distance below the upper wall 41' to provide adequate passage for the spray material from the bore 23 to the upper tangential channel 42'. The upper surface 48' of the stem can be spaced 0.005 to 0.100 inch, preferably 0.025 to 0.075 inch below the upper wall 41' of the sprayhead socket.

The distance that upper surface 48' is spaced below upper wall 41' is determined to some extent by the size of the orifice 38 and is such that a substantially even flow of spray material in the upper and lower tangential channels 42' is obtained. The inner wall surface 29 of the sprayhead socket 28 has a central opening that forms the exterior spray orifice 36. Coaxially with the orifice 36 there is a swirl forming chamber 47'. The chamber 47' is shown here as generally square and has two tangential branches or channels 42'. The tangential channels are generally square in cross-section. The bottom wall of the swirl chamber and the bottom wall of the lower tangential channel is made to slant inwardly into the inner wall surface of the sprayhead socket.

Swirl chamber 47' communicates directly with the spray orifice 36. Swirl chamber 47' communicates through the upper tangential channel 42' and the lower tangential channel 42' with communicating passage 67 and lower annular channel 39, respectively. Swirl chamber 47' and tangential channels 42' are formed in the inner wall surface 29 of the frusto-conical shaped portion of the socket 28 during the molding of the sprayhead 1''.

When the stem is pressed into the socket and forms a tight fit therewith there will be formed between the inner wall of the frusto-conical shaped portion 29 of the socket 28 and the frusto-conical portion 24 of the valve stem 18, the swirl chamber 47', two tangential passages 42', the communicating passage 67 and the annular passage 39. The upper wall surface 41' of the socket 28 with the upper wall 48' of the valve stem 18 form the communicating passage 67. Pressurized mixture entering through communicating passage 67 and annular channel 39 will pass, respectively into the upper tangential channel 42' and the lower tangential channel 42' and from the tangential channels 42' into the swirl chamber 47'.

The propelled mixture enters the swirl chamber 47' at two points tangential to the chamber causing a rotative or swirl movement of the propelled mixture within the chamber 47' and is discharged through spray orifice 36.

It will be appreciated from the above discussion that the embodiment shown in FIGS. 7 and 8 is similar in construction and operation to that shown in FIGS. 3 and 4 except that in FIGS. 7 and 8 the upper annular channels 51 and notch 37 have been omitted and communication between the bore 23 and the upper tangential channel means is provided by passage communicating 67.

Figure 9:
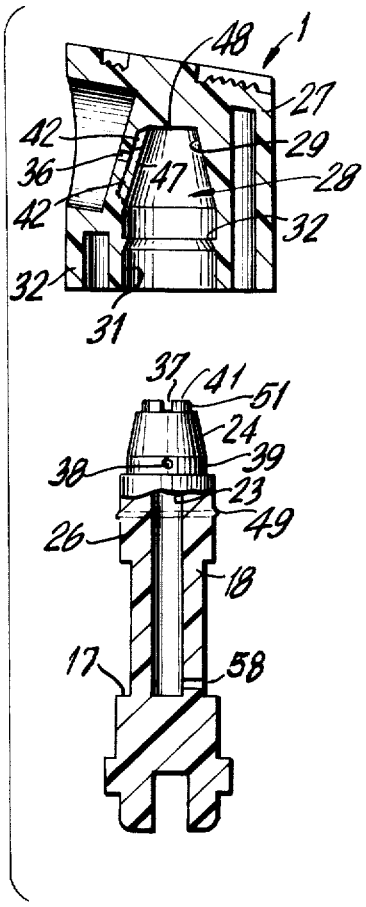
FIG. 9 is an exploded view of a sprayhead and conventional stem type valve construction.

FIG. 9 is an exploded view showing the sprayhead 1, stem 18 and a conventional stem valve type plunger. In this drawing, the relationship between the various parts of the stem and sprayhead can be easily visualized. The sprayhead and valve stem construction are the same as shown in FIGS. 3 and 4. The bore 23 of the hollow stem 18, communicates with slot 37 formed in the top of the stem 18. The top inner wall surface 41 of the socket is dimensioned to form a close fit with the top wall surface 48 of the stem when the stem and socket are engaged. The stem 18 and valve plunger 11 are integrally molded together. When in place in the valve assembly (see FIG. 2) the tubular stem 18 protrudes through the aperture 9 in gasket 8 and through the opening 7 in boss 6. The bore 23 of the hollow stem 18 is closed at its lower end and open at its upper end. There is a transverse aperture 58 at the bottom of the bore 23 adjacent the closed end which when the valve is in the closed or at rest position is normally sealed by gasket 8. The construction and operation of the valve assembly is otherwise similar to that discussed with reference to FIG. 2.

Figure 10:
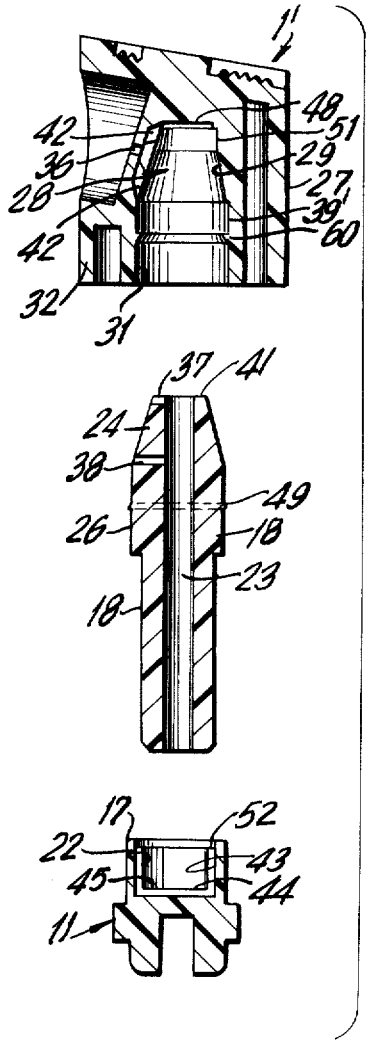
FIG. 10 is an exploded view of a sprayhead and simplified valve stem and valve plunger construction.
Figure 11:
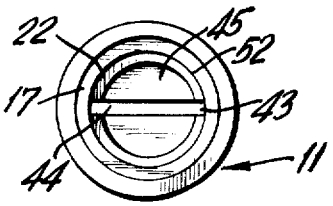
FIG. 11 is a top plan view of the valve plunger of FIG. 10.

FIGS. 10 and 11 illustrate another embodiment of the invention in which the stem and valve plunger structures are further simplified. The construction and operation of the sprayhead and stem are as discussed above with reference to FIGS. 5 and 6. The stem 18 is imperforate throughout its length except for slot 37 and orifice 38 in the upper portion of the stem. There are no other slots, apertures, grooves or any other openings in the surface of the stem wall. This construction makes the stem a very simple structure which is very easy and economical to make. The construction of the valve plunger is also simple, economical and easy to make. The interior of the plunger 11 provides a socket 22 which has a blind bottom end which forms a floor 45. The upper end of the socket 22 can have a gallery 52 that extends around the interior thereof, giving rise to a narrow section that has an end surface which forms the valve seat 17. The inner wall of socket 22 has one or more vertically disposed metering channels 43 formed therein. These channels opens at their upper ends into the gallery 52 and extend slightly below floor 45 at their bottom ends and open into groove 44.

The stem 18 fits into the socket 22. The diameter of the stem 18 is such as to form a tight sealing fit in the socket 22 of plunger 11. The channels 43 together with the outer wall surface of the stem form passageways of predetermined cross-sectional areas. The channels open at their upper end adjacent the valve seat 17 and open at their bottom end adjacent the floor 45. Since the lower end of the stem is imperforate except at its axial bottom end, no pressurized material can escape except by way of metering channels 43 and groove 44.

FIG. 11 is a plan top view of valve plunger 11 showing the upward facing socket 22. The upper outer edge of the plunger forms the valve seat 17. The top portion of the metering channel 43 opens into gallery 52 and the bottom portion communicates with the groove 44 formed in the bottom floor 45 of socket 22.

In the FIGS. 1–11 of the drawings the metering can take place in one or more of the spray orifice 36, slot 19, aperture 58, metering channels 43, slot 37, orifice 38 and tangential channels 42 depending on the relative cross-sectional area of each. The metering occurs at the place of the smallest cross-sectional area. Excellent metering control without loss of efficiency of dispersion and atomization may be achieved by varying the dimensions of swirl chamber 47, tangential channels 42, and/or the external orifice 36. Metering can also be effected by varying the height and/or width of slot 19 above valve seat 17. The tangential channels 42, can be V-shaped, rounded or generally square in cross-section. The preferred construction, however, is generally V-shaped with a flat bottom to the V. The swirl chamber can be round or generally square.

It will be understood that certain additional changes may be made in the construction or arrangement of the sprayhead and stem disclosed herein without departing from the spirit and scope of the invention as defined in the appended claims.

I clalim:

1. A sprayhead and valve stem combination which cooperate to form a mechanical breakup swirl forming and dispersing means for pressurized materials including a sprayhead having a spray orifice and a socket with an inner wall surface for engagement with the valve stem, the valve stem having an outer wall surface and being hollow with a central bore, the stem when engaged in the sprayhead socket depending therefrom, the swirl forming means comprising a swirl chamber arranged concentrically to said orifice, two tangential channels and communicating means connecting the tangential channels to the stem bore, the tangential channels directed into the swirl chamber, the swirl chamber and tangential channels are formed by depressions molded into the inner wall surface of the sprayhead socket, the swirl chamber and tangential channels are covered by the tightly fitted outer wall surface of the stem, the tangential channels with the outer wall surface of the stem form passageways for pressurized material, the communicating means comprise upper and lower passageways, the swirl chamber communicates with the spray orifice, one of the tangentail channels communicate at one end with the swirl forming chamber and at the other end with the upper passageway and the other tangential channel communicates at one end with the swirl chamber and at the other end with the lower passageway.

2. The sprayhead and valve stem combination of claim 1 in which the communicating means connecting the tangential channels to the stem bore comprise upper and lower annular channels.

3. The sprayhead and valve stem combination of claim 1 in which the communicating means connecting the tangential channels to the stem bore comprise an upper communicating passage formed between the upper portion of the sprayhead socket and the upper portion of the valve stem, and a lower annular channel.

4. The sprayhead and valve stem combination of claim 1 in which the sprayhead has a frusto-conical shaped socket portion and the upper end of the stem has a frusto-conical shaped portion, the swirl forming chamber and tangential channels are formed in the frusto-conical shaped portion of the sprayhead socket and the communicating means connecting the tangential channels to the stem bore are formed between the frusto-conical shaped stem portion and the frusto-conical shaped portion of the socket and the frusto-conical shaped portion of the stem and the frusto-conical shaped portion of the socket are dimensioned to have a tight fit.

5. The sprayhead and valve stem combination of claim 1 in which the sprayhead has a frusto-conical shaped socket portion and the upper end of the stem has a frusto-conical shaped portion, the swirl forming chamber and tangential channels are formed in the frusto-conical shaped portion of the sprayhead socket, the communicating means connecting the tangential channels to the stem bore comprise upper and lower annular channels, the annular channels are formed in the frusto-conical shaped stem portion, and the frusto-conical shaped portion of the socket and the frusto-conical shaped portion of the stem are dimensioned to have a tight fit.

6. The sprayhead and valve stem combination of claim 1 in which the sprayhead has a frusto-conical shaped socket portion and the upper end of the stem has a frusto-conical shaped portion, the communicating means connecting the tangential channels to the stem bore comprise upper and lower annular channels, the swirl forming chamber, the tangential channels and annular channels are formed in the frusto-conical shaped portion of the sprayhead socket, and the frusto-conical shaped portion of the socket and the frusto-conical shaped portion of the stem are dimensioned to have a tight fit.

7. The sprayhead and valve stem combination of claim 1 in which the communicating means connecting the tangential channels to the stem bore comprise a first communicating passage formed by spacing the top of the valve stem a short distance below the top of the sprayhead socket, and a second communicating passage formed below the first communicating passage by an annular channel defined between the stem and sprayhead socket and an opening in the stem wall, said opening connecting the stem bore to the annular channel, each of said communicating passages being connected to one of the tangential channels.

8. A sprayhead and valve stem combination which cooperate to form a mechanical break-up swirl forming and dispersing means for pressurized materials including a sprayhead having a spray orifice and an inner frusto-conical shaped socket with an inner wall surface for engagement with the valve stem, the valve stem having at its upper end a frusto-conical shaped portion which conforms in shape to the sprayhead socket, said valve stem having an outer wall surface, being hollow and having a central bore, the stem when engaged with the sprayhead depends therefrom, the mechanical break-up swirl forming means comprising a swirl forming chamber arranged concentrically to said orifice, two tangential channels directed into the swirl chamber, two annular channels and first and second communicating passages, the swirl chamber, tangential channels and annular channels are formed between the frusto-conical shaped portion of the sprayhead socket and the frusto-conical shaped portion of the stem, the first and second communicating passages are formed in the stem, the swirl forming chamber communicates with the spray orifice, the tangential channels communicate at one end with the swirl forming chamber and at the other end with each one of the annular channels, the first and second communicating passages each communicate with one of the annular channels and provide communication between the bore of the stem and the respective tangential channels.

9. The sprayhead and valve combination of claim 8 in which the swirl forming chamber and tangential channels are formed by depressions molded into the inner wall surface of the sprayhead socket and the two annular channels are formed by depressions molded into the wall surface of the valve stem.

10. The sprayhead and valve stem combination of claim 8 in which there is an upper annular channel and a lower annular channel, a first communicating passage means formed by a notch in the top frusto-conical shaped portion of the stem and a second communicating passage means formed below the first means by an orifice in the wall of the stem, and the first communicating passage means communicating with the upper annular channel and the second communicating passage means communicating with the lower annular channel.

11. A sprayhead and valve stem combination which cooperate to form a mechanical break-up swirl forming and dispersing means for pressurized materials including a sprayhead having a spray orifice and a frusto-conical shaped socket, the socket having an inner wall surface for engagement with the stem, the stem having at its upper end a frusto-conical shaped portion which conforms in shape to the sprayhead socket, the stem having an outer wall surface, being hollow and having a central bore and when engaged with the sprayhead depends therefrom, the mechanical break-up swirl forming means comprising a swirl chamber arranged concentrically to said orifice, two tangential channels directed tangentially into the swirl chamber, two annular channels and first and second communicating passages, the swirl chamber and tangential channels are formed by depressions molded into the inner wall surface of the frusto-conical shaped portion of the sprayhead, the swirl chamber and tangential channels are covered by a tightly fitted outer wall surface of the frusto-conical shaped portion of the stem, the annular channels are formed by depressions molded in the stem, the annular channels are covered by a tightly fitted inner wall surface of the frusto-conical shaped portions of the sprayhead, the first communicating passage means is provided in the upper portion of the stem and the second communicating passage means is provided in the stem below the first communicating passage means, the swirl forming chamber communicates with the spray orifice, the tangential channels communicate at one end with the swirl forming chamber and at the other end with one of the annular channels and the first and second communicating passages each communicate with one of the annular channels and the stem bore.

12. A sprayhead and valve stem combination which cooperate to form a mechanical break-up swirl forming and dispersing means for pressurized materials including a sprayhead having a spray orifice and a frusto-conical shaped socket, the socket having an inner wall surface for engagement with the stem, the stem having at its upper end a frusto-conical shaped portion which conforms in shape to the sprayhead socket, the stem having an outer wall surface, being hollow and having a central bore and when engaged with the sprayhead depends therefrom, the mechanical break-up swirl forming means comprising a swirl forming chamber arranged concentrically to said orifice, two tangential channels directed into the swirl chamber and communicating means connecting the tangential channels to the stem bore, the swirl chamber and tangential channels are formed by depressions molded into the inner wall surface of the frusto-conical shaped portion of the sprayhead, the swirl chamber and tangential channels are covered by a tightly fitted outer wall surface of the frusto-conical shaped portion of the stem, the communicating means comprising a first communicating passage formed by spacing the top of the valve stem a short distance below the top of the sprayhead socket, and a second communicating passage formed below the first communicating passage by an annular channel defined between the stem and sprayhead socket and an opening in the stem wall, said opening connecting the stem bore to the annular channel, the swirl forming chamber communicates with the spray orifice, the tangential channels each communicate at one end with the swirl chamber, and each of the communicating passages communicating with one of the tangential channels.

13. An aerosol valve assembly including a valve plunger and a sprayhead and valve stem combination which cooperate to form a mechanical break-up swirl forming and dispersing means for pressurized materials, the sprayhead having a spray orifice and a frusto-conical shaped socket, the socket having an inner wall surface for engagement with the stem, the stem having at its upper end a frusto-conical shaped portion which conforms in shape to the sprayhead socket, the stem having an outer wall surface, being hollow and having a central bore and when engaged with the sprayhead depends therefrom; the mechanical break-up swirl forming means comprising a swirl forming chamber arranged concentrically to said orifice, two tangential channels, and first and second communicating passages; the swirl chamber and tangential channels are formed by depressions molded into the inner wall surface of the frusto-conical shaped portion of the sprayhead, the swirl chamber and tangential channels are covered by a tightly fitted outer wall surface of the frusto-conical shaped portion of the stem, the communicating passages are formed between and in the frusto-conical shaped portion of the socket and the frusto-conical shaped portion of the stem; the swirl forming chamber communicates with the spray orifice, the tangential channels each communicate at one end with the swirl forming chamber and at the other end with the one of the communicating passages and the communicating passages each communicate with the stem bore.

14. The valve assembly of claim 13 in which the valve plunger has an upward facing socket, the stem slidingly and sealingly fits into the valve plunger socket, the upper edge portion of the plunger forms a circular valve seat, the lower portion of the stem has an axial elongated slot in its outer wall surface which when the stem is fully seated in the socket extends a short distance above the valve seat.

15. The valve assembly of claim 13 in which the valve plunger has an upward facing socket, the stem slidingly and sealingly fits into the valve plunger socket, the socket has a blind bottom floor, the floor has therein a radially extending groove, the upper end of the plunger forms a circular valve seat, the lower end of the stem is imperforate except for an axial end opening, the inner wall surface of the socket of the valve plunger has vertical metering channels, said channels open at their upper ends adjacent the valve seat and open at their lower ends slightly below the floor of the socket and communicate with the radially extending groove.

16. The valve assembly of claim 13 in which there is a gallery formed below the valve seat in the upper end of the plunger and in which the upper ends of the channels open into said gallery.

17. The aerosol valve assembly of claim 13 in which the valve plunger is molded integrally with the stem, the upper edge of the valve plunger forms a circular valve seat, the bore of the hollow stem is closed at its lower end and has a transverse aperture through the stem wall at the lower end thereof adjacent the valve seat and providing communication between the inside and the outside of the hollow stem.

* * * * *